United States Patent [19]

Bardwell

[11] Patent Number: 5,022,474

[45] Date of Patent: Jun. 11, 1991

[54] MULTIPLE BLOW PERCUSSION DRILL ASSEMBLY WITH RAPID FIELD MAINTENANCE AND ADJUSTMENT CAPABILITY

[76] Inventor: Allen E. Bardwell, 900 Shenandoah Shores Rd., Front Royal, Va. 22360

[21] Appl. No.: 492,476

[22] Filed: Mar. 12, 1990

[51] Int. Cl.[5] ..... E21B 4/08

[52] U.S. Cl. ..... 175/299; 29/436; 166/178; 166/378

[58] Field of Search ..... 175/299, 293; 173/112, 173/139; 166/178, 378; 29/436, 434

[56] References Cited

U.S. PATENT DOCUMENTS

| | | | |
|---|---|---|---|
| 3,203,482 | 8/1965 | Lyles | 175/299 |
| 3,303,899 | 2/1967 | Jones, Jr. et al. | 175/299 |
| 3,409,091 | 11/1968 | Bardwell | 175/299 X |
| 3,409,095 | 11/1968 | Bardwell | 175/299 |
| 4,440,245 | 4/1984 | Bardwell | 175/299 X |
| 4,607,692 | 8/1986 | Zwart | 175/299 X |
| 4,694,917 | 9/1987 | Heidemann et al. | 175/299 |

*Primary Examiner*—Stephen J. Novosad
*Attorney, Agent, or Firm*—James F. Cottone

[57] ABSTRACT

A multiple blow percussion drill assembly is specially configured to provide significantly increased maintainability and adjustability in the field, thereby greatly extending its service life and usefulness over a wide variety of drilling conditions. Both spring replacement and impact hammer delay time variations are rapidly accomplished by virtue of unique positioning and interactions of the internal components, without the need for dissassembly of the sealed high impact energy portion of the drill assembly. Advantageously, a first chamber housing the high impact energy transferring components is isolated from a second chamber housing the control components, such that the control components may be rapidly cleaned, adjusted, or replaced via a simple access port.

19 Claims, 1 Drawing Sheet

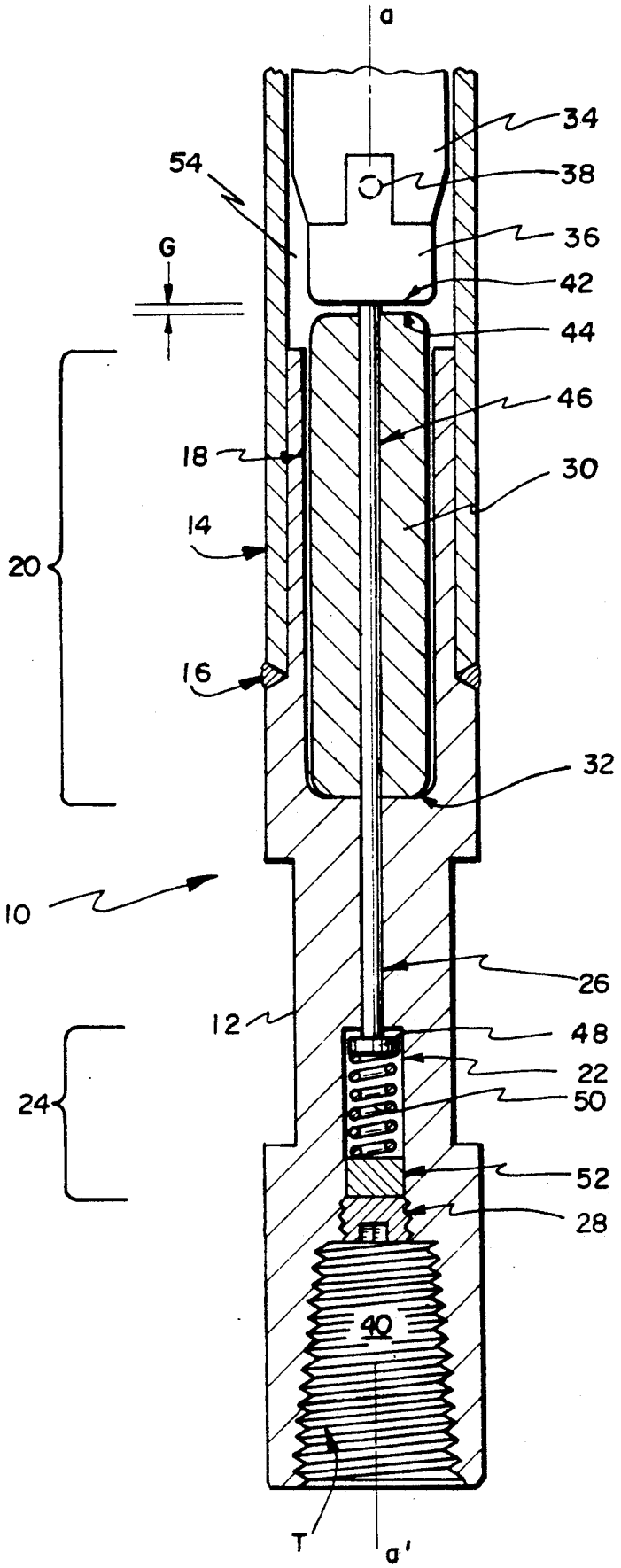
a
34
38
54
36
G
42
44
46
18
30
14
20
16
32
10
26
12
48
22
24
50
52
28
40
T
a'

MULTIPLE BLOW PERCUSSION DRILL ASSEMBLY WITH RAPID FIELD MAINTENANCE AND ADJUSTMENT CAPABILITY

BACKGROUND OF THE INVENTION

1. Field of the Invention

The present invention relates generally to gravity drop percussion drills, and more particularly to an improved multiple blow percussion drill assembly having specially configured internal components to increase its service life and to facilitate rapid field repairs.

2. Description of the Prior Art

Methods and apparatus for drilling holes in the earth as needed for the sinking of deep wells, and the like, have a long history of development. The need to drill these wells in rocky terrain gave rise to the early and well known technique of percussion drop drilling wherein a cable suspended from a drill rig is fitted with a cutting tool or bit at its lower end, all of which is alternately hoisted and abruptly dropped to effect the desired crushing/drilling action. Generally, powered equipment is used to hoist the heavy components involved. Energy converted from the gravity drop affects the cutting action, and drill bits of hardened steel which may include carbide tips are employed. This basic approach has been refined over the years to include improved percussion drilling devices which deliver multiple blows based on stored energy elements within the drill bit assembly. Whereas the early percussion drill techniques used a fairly simple and solid drill stem, the multiple blow devices called for hollow drill stems having internal hammer/anvil/spring components. Significantly improved penetrations were achieved as the energy of the internal hammer striking the internal anvil added to the initial drill bit impact just at the time when the bit and rock formation are under compression. Descriptions of typical prior art drills of this multi-blow type are found in U.S. Pat. Nos. 3,409,091, 3,409,095, and 4,440,245 all to A. E. Bardwell—as well as in U.S. Pat. No. 2,872,158 to Green. In the drilling community, these multiple blow, gravity drop percussion drills are often referred to as chatter hammers due to their rebounding action, and these two designations will be used interchangeably throughout the present description.

In actual operation of the prior art devices, the weight, size, and severe operating conditions required of them combined to greatly limit the useful life of these drill types. As the devices were made stronger to withstand the rigorous operating conditions—often by fabricating them as sealed units—they became less amenable to routine repairs in the field. Substantial costs and weeks of delay were often encountered because when the springs contained inside a welded or completely sealed tube broke, there was no easy way for the driller to replace it in the field without the use of a machine shop. All steel components have, of course, a finite expected life and replacement of springs, cleaning out of normal wear and tear metallic debris, and other maintenance procedures must be provided for. This is precisely where the prior art devices fell short. For example, to gain access to these early chatter hammers required a lathe cutting away the welds used to join the various sections as well as the application of heat to swell the casing in order to remove the plugged end. This was not only very costly, but prevented quick reassembly due to the resulting changes in length of the tubing. These changes would necessitate the shortening of the hammer to assure the correct gap between the hammer and anvil—all of which is well beyond the capabilities associated with a field drilling team. Therefore, it is clear that a pressing need exists for an improved multi-blow percussion drill which yields the desired benefits of greatly increased rock penetration rates, and avoids the unduly short service life caused by poor capability of being maintained and adjusted under field conditions.

SUMMARY OF THE INVENTION

It is therefore a primary object of the present invention to provide an improved multiple blow percussion drill assembly for carrying a drill bit, and one which will overcome the disadvantages of severely limited field maintenance/adjustment capability.

A further object of the present invention is to provide a multiple blow percussion drill assembly which will yield greatly increased service life by providing rapid access to facilitate replacement of internal components subjected to normal wear.

A yet further object of the present invention is to provide a multiple blow percussion drill assembly which provides greatly increased service life by configuring and locating the internal components such that the massive, high impact energy components are confined to a first chamber and the smaller, shorter lived control components are confined to a second chamber.

A still further object of the present invention is to provide a multiple blow percussion drill assembly wherein the hammer biasing spring located in the second chamber may be rapidly replaced by the simple removal of chamber locking means, such as a retaining screw, with the chamber/spring/ screw all positioned in the lower extremity of the drill assembly so that none of these components are subjected to heavy impact forces or ambient debris.

In a preferred embodiment, a multiple blow percussion drill assembly has an upper axial chamber for housing a hammer/anvil pair, and a smaller, lower axial chamber for housing the hammer biasing spring. The spring upwardly urges a narrow lifting rod fitted through a narrow vertical passageway interconnecting the two chambers to statically maintain the hammer a desired height above the anvil. Due to this unique two chamber structure, and the advantageous positioning of the biasing spring in the axial chamber or pocket at the lower extremity of the drill assembly, major benefits flow. These benefits include: preventing heavy tool impact pressure from contacting the spring which would greatly shorten the spring life; precluding the accumulation of debris from the high energy components within the spring coils, thus greatly extending the service life of the spring; allowing access via the bottom of the drill assembly to the spring chamber, thereby permitting rapid field replacement of aged springs, allowing straightforward positioning of spacers and/or shims in the spring pocket to adjust the timing of the chatter hammer blows; and increasing the service life of the drill assembly by increasing its adjustability and maintainability, while lowering its life cycle costs.

BRIEF DESCRIPTION OF THE DRAWINGS

Additional objects and advantages of the present invention will become apparent to those skilled in the art as the description proceeds with reference to the accompanying drawing wherein:

The FIGURE is a longitudinal cross-sectional view of an improved multiple blow percussion drill assembly embodying the rapid spring replacement and adjustment capability, according to the present invention.

DETAILED DESCRIPTION OF THE PREFERRED EMBODIMENT

Referring now to the FIGURE there is shown a longitudinal cross-section of an improved gravity percussion drill assembly embodying the maintainability and adjustability features according to the present invention. The lower end of a drill assembly 10 includes an elongated, generally cylindrical box member 12 which is interconnected to the remainder of the drill string by an elongated tubular casing 14. The box 12 and casing 14 may be joined by conventional heat/shrink and welding techniques along a bead joint 16 to form a unitary assembly, within which the operating elements of the drill assembly are housed. The various components making up the drill assembly 10 are symmetrical about a longitudinal axis a-a' unless otherwise noted, and are fabricated from a variety of steel types. An elongated cylindrical anvil chamber 18 is formed longitudinally within an upper section 20 of the box 12, and a smaller, elongated cylindrical spring chamber 22 is formed in a lower section 24 of the box 12. The two chambers are joined by a centrally disposed, axial rod passageway 26 whose diameter is substantially less than that of the anvil chamber 18, and somewhat less than that of the spring chamber 22. The lower end of the spring chamber 22 is internally threaded to accept an undercut allen head nut 28 which closes off its bottom end.

The anvil chamber 18 carries a snugly fitted anvil 30 which rests on a smoothly machined bottom floor 32 formed into the lower end of the chamber 18. The lower surface of the anvil 30 is shaped to mate with the floor 32 so as to optimally deliver and transfer its impact to the stronger solid section of the box 12 via the floor 32 rather than to the area of the weld bead joint 16. Above the anvil chamber 18, a lower region within the tubular casing 14 houses a hammer body 34 which is free to move vertically within the casing 14, the hammer body 34 having a hardened steel tip 36 of slightly lesser diameter to conform to its mating surface of the anvil 30. A stem portion of the hardened tip 36 is pressed into an axial cavity formed into the hammer 34 and is securely retained by a steel pin 38. Ideally, the structures described thus far and those to be described hereinbelow are relatively positioned (under static conditions) within the box 12 and casing 14 so as to maintain a lower impact surface 42 of the tip 36 a desired, predetermined distance above an upper impact surface 44 of the anvil 30. This gap distance (not shown to scale) is designated by the symbol "G". The dynamics of the gap "G" formed between these two surfaces is discussed in more detail in the aforementioned U.S. Pat. No. 3,409,091 to Bardwell.

The hammer 34 is held in this desired, pre-impact position (alternately designated as the cocked position) by a lifting rod 46 routed through an interior passageway in the anvil 30. A lower end of the rod 46 is flared out to form a spring engaging disk 48. The rod 46 fits loosely into the passageway 26 and upwardly biases the hammer 34 under the urging of a helical spring 50 retained within the spring chamber (or pocket) 22. Spring loading, and static positioning of the lifting rod 46 and hence the hammer 34, are provided via a spacing element 52 which is vertically positioned by the advance of the locking screw 28. Advantageously, the chamber 22 and its sealing/locking means 28 are positioned within the cone shaped sheltered area 40 formed to accept a drill bit (not shown) which is conventionally threadedly mounted to engage the tapered teeth treads "T".

A number of significant benefits flow directly from the improved drill assembly structure detailed above. For the most part, these benefits derive from the unique structures, relative positioning, and interaction of the elements described, and many of the benefits are closely interrelated. For example, as will be described below, the improved chatter hammer exhibits a dramatically longer service life in field operations due to the rapidity with which the spring can be replaced. Spring replacement times of less than one-half hour are typical of this preferred embodiment, and compare favorably to the many weeks of production previously lost with prior art devices due to the extensive machining/welding steps needed to accomplish the same replacement. Therefore, while the various benefits provided by the present invention may appear to merge, they can be separately distinguished.

Firstly, the present invention allows the straightforward removal and replacement of the spring 50 by merely unscrewing the allen screw locking member 28 to gain direct access to the spring chamber 22. Any accumulated fine debris is similarly readily removed by the out flowing of lubricant, which further contributes to the useful life of the spring 50. Both spring replacement and cleaning can be accomplished with the improved chatter hammer drill assembly in place on the drilling rig. This capability is in direct contrast with the previously known devices wherein a variety of spring and placement locations are employed, all of which require the spring/hammer/anvil elements to be sealed—as by welding—within the robust housings in order to survive the severe forces incurred. Therefore, a clear improvement in drill assembly maintainability is provided by the present approach.

Secondly, the present invention allows the rapid adjustment of spring loading to optimize the delay time of the hammer 34 action on the anvil 30 after initial impact. The length of the spacer 52 in combination with the rest length and spring constant of spring 50 provides the desired adjustment of the spring load and gap height "G"; and the corresponding delay times are easily controllable. This adjustability produces significantly improved results when drillers encounter variable rock conditions. Typically, it is very beneficial to be able to readily increase the spring load—without changing sealed box units—to delay the hammer action in soft rock formations where the deceleration of the external force takes a longer period of time. Typical static spring loading levels in a preferred embodiment of the present invention are in the 400–700 pound range, with the allen screw 28 fully tightened into its threaded cavity. In softer formations, the combination of water and cuttings within the hole creates a hydraulic resistance to the crop cycle. As the tool drops, its velocity decreases as it nears the end of its travel. If the spring tension is equal only to the weight of the hammer (say, 400 lbs.), the hammer will settle toward the anvil (or rest on the anvil at impact time) losing the vital secondary impact. By increasing the spring load to say, 800 lbs., the 400 lb.

hammer will stay in the cocked position during the deceleration period and will effectively transmit its energy to the anvil and rock formations. All prior art devices generally set spring tension to equal the hammer weight, and so could not be readily adjusted for softer formations. Therefore, a clear improvement in drill assembly adjustability is provided by the present invention.

Thirdly, the use of the very narrow lifting rod—in the three-quarter inch diameter range—provides a greatly increased area of the hammer surface 42 to impact on the top i0 anvil face 44. BeYond the immediate advantage of allowing greater hammer weights over all the prior art chatter hammers where the hammer had to be narrow enough to pass through the center of its supporting spring, this increased surface area has the further advantage of minimizing wear and deformation on the hammer/anvil impacting surfaces. This reduces the amount of debris produced, also increasing the service life of the improved drill assembly.

Fourthly, by providing two separate and distinct chambers for housing the two separate sets of operating elements, metal debris from wear of the high impact energy components in chamber 18 is prevented from clogging the control components in chamber 22. Thus, metal debris from normal wear between the outer walls of the hammer 34 and the inner wall of the casing 14 collects in a space 54 and is suspended in lubricating oil (not shown), and is largely prevented by the tolerances between the rod 46 and its passageway 26 from clogging the coils of the spring 50. In the absence of any major accumulation of metal debris within the coils of spring 50, its premature failure is forestalled. Thus, the full expected service life of the spring may be realized, further extending the field service of the improved chatter hammer configured accordingly to the present invention.

Fifthly, both the assembly during initial fabrication of the improved chatter hammer, as well as subsequent field maintenance and repair, are greatly improved by virtue of the unique structures embodied in the present invention, and their resulting unique interactions. During initial assembly, the anvil 30 is inserted into the chamber 18 of the box member 12, and the box member 12 is then welded to the lower end of the tubular tubing 14, as previously described. Then, the completed hammer 34, assembled to its hardened tip 36 as previously described, is inserted from the upper end of the tubing 14 so that the lower surface 42 of its tip 36 comes to rest against the upper surface 44 of the anvil 30 Having the anvil 30 and hammer 34 in this relaxed position within the closed drill assembly 10 is in itself a major improvement over prior art chatter hammer devices. All of the known prior art devices generally required several hundreds of pounds of restraining force to retain the hammer/spring/anvil assemblies in their desired relative positions while their outer drill assemblies were being assembled and sealed, as by welding. So, it has heretofore not been a simple matter to carry out the final assembly of these chatter hammers, and hence considerable man hours and special assembly jig costs (as well as carefully controlling the where and when of welding heat) all added to the overall expense of the prior art devices. As detailed above, field maintenance for the shorter lived components is speedily accomplished via the easy access to the spring chamber 22 for—replacing a worn spring 50; replacing the spacer 52 to vary or control impact delay times; and generally removing debris and renewing lubricants.

It is also readily apparent that shims (not shown) may be inserted behind the disk 48, to supplement the different length spacers 52, thereby providing slight increases in lifting rod static position. This provides a very economical method of compensating for small changes in spring properties due to aging, minor fatigue, or setting for any of a number of reasons.

In an illustrative embodiment, the following approximate dimensions were found to provide the advantageous results detailed above. The tubular casing 14 may be several feet in length and may have an inner diameter of 3½ inches, an outer diameter of 4½ inches, and may overlap the box member 12 for some 6 inches before it is terminated at the weld bead 16. The box member 12 may be 2 feet in length with its outer diameter machined to 4½ inches, and may be fabricated from one or more high strength steel billets welded together. Regarding the internal components, the anvil 30 may be 8 to 9 inches in length and of 3 inch diameter, with the diameter of its interior passageway being just over ½ inch. The spring chamber 22 may be some 6 to 7 inches in length with an inner diameter of 1½ inches, and the allen screw 28 may have an overall length of between 1 and 2 inches. Other locking means may, of course, be used including quick-disconnect bayonet types. Dimensions of the various other components may be inferred from the above, and the actual sizes and materials of the high energy components, such as the hammer 34 and the anvil 30, may be varied to meet particular design load and service life requirements.

Although the invention has been described in terms of a preferred embodiment, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A multiple blow percussion drill assembly for carrying a drill bit comprising:

(a) an elongated tubular housing having first and second vertically displaced longitudinal chambers interconnected by a vertical axial passageway of narrow bore, and further having an aperture at its lower extremity including means for retaining said drill bit and means for accessing said second chamber;

(b) said first chamber positioned at an upper portion of said housing for containing one or more movable impact energy transfer components;

(c) said second chamber positioned at a lower portion of said housing for containing components for controlling the operation of said impact energy transfer components;

(d) a narrow lifting element positioned within said passageway for transferring an upwardly biasing force from at least one of said control components in said second chamber to at least one of said impact energy transfer components in said first chamber;

(e) whereby upon actuating said accessing means, said control components may be readily removed for maintenance.

2. The drill assembly of claim 1 wherein said impact energy transfer components comprise a vertically movable hammer positioned above an anvil, said anvil having a vertical axial passageway of narrow bore for transferring said biasing force via said lifting element to controllably lift said hammer above said anvil by a predetermined distance.

3. The drill assembly of claim 2 wherein said control components include a helical spring for providing the force to lift the hammer said predetermined distance, and said lifting element comprises a narrow, elongated lifting rod.

4. The drill assembly of claim 3 wherein said means for accessing comprise a locking member threadably inserted into an axial opening formed into the lower wall of said second chamber whereby said spring may be removed for maintenance through said opening upon removal of said locking member.

5. The drill assembly of claim 4 wherein said control components further comprise a spacing member insertable with said helical spring into said second chamber and retained by said locking member for adjusting the predetermined spring load of said hammer above said anvil via said lifting rod.

6. The drill assembly of claim 2 wherein said anvil comprises a separate element moveable within said first chamber for transferring substantially all of said hammer impact energy into said housing.

7. The drill assembly of claim 3 wherein said axial passageway has a longitudinal extent substantially greater than its transverse extent and said transverse extent further being substantially lesser that the transverse extent of said first and second chambers, and wherein said lifting rod also has a longitudinal extent substantially greater than its transverse extent which is closely fitted within said passageway whereby the control components within said second chamber are largely isolated from the impact energy transfer components within said first chamber.

8. The drill assembly of claim 4 wherein said threadably inserted locking member is a bayonet type locking member.

9. The drill assembly of claim 5 wherein said spacing member may comprise one or more spacing elements which act in combination with other control components for adjusting said predetermined spring load.

10. The drill assembly of claim 5 wherein said spacing member may comprise one or more spacing elements which act in combination with other control components for adjusting said predetermined distance.

11. A method of improving the maintainability of a multiple blow percussion drill assembly comprising the steps of:

(a) providing an elongated tubular drill assembly housing having a vertically disposed longitudinal axis and having a first longitudinal chamber located above a second smaller longitudinal chamber;

(b) providing an axial passageway having a longitudinal extent substantially greater than its transverse extent between the first and second chambers, said transverse extent further being substantially lesser than the transverse extent of said first and second chambers;

(c) providing one or more impact energy transfer means within said first chamber and providing helical spring control means within said second chamber for controlling in part said impact energy transfer means via said axial passageway;

(d) providing access means to said second chamber via an opening in the lower extremity of said housing thereby allowing ready access to the control means for maintenance without the need to disassemble in whole or in part said impact energy transferring means within said first chamber.

12. The method of claim 11 including the further step of providing a lifting rod having a longitudinal extent substantially greater than its transverse extent as a close fitting element within said passageway whereby said control means may in part controllably position said impact energy transfer means via said lifting rod while substantially preventing the accumulation of impact energy transfer means wear products within said second chamber.

13. The method of claim 12 including the further step of providing a helical spring as said control means and a threaded member in said access means opening to lockably retain said spring in said second chamber whereby rapid access to said spring for maintenance may be accomplished by removal of said threaded member.

14. The method of claim 12 including the further step of providing a bayonet locking member in said access means opening to lockably retain said spring in said second chamber whereby very rapid access to said spring for maintenance may be accomplished.

15. A method of improving the adjustability of a multiple blow percussion drill assembly for carrying a drill bit, comprising the steps of:

(a) providing an elongated tubular drill assembly housing having a first longitudinal chamber vertically located above a second smaller longitudinal chamber;

(b) providing an axial passageway having a longitudinal extent substantially greater than its transverse extent between the first and second chambers, said transverse extent further being substantially lesser than the transverse extent of said first and said second chambers;

(c) providing one or more impact energy transferring means within said first chamber and providing a helical spring within said second chamber for controlling in part said impact energy transferring means via said axial passageway;

(d) providing access means to said second chamber via an opening in the lower extremity of said housing; and (e) providing one or more spacing elements for inclusion with said spring in the second chamber whereby said controlling in part includes controlling the static relative positioning of said impact energy transfer means response to said spacing elements.

16. The method of claim 15 including the further step of providing access means to said second chamber via an opening in the lower extremity of said housing thereby allowing ready access to said spring and said one or more spacing elements without the need to disassemble in whole or in part said impact energy transfer means.

17. The method of claim 16 including the further step of providing a lifting rod having a longitudinal extent substantially greater than its transverse extent as a close fitting element within said passageway whereby said spring and said one or more spacing elements may in concert controllably position said impact energy transferring means via said lifting rod.

18. The method of claim 17 including the further step of providing a threaded member in said access means opening to lockably retain said spring and said one or more spacing elements in the second chamber whereby rapid access to said control elements for adjustability may be accomplished by removable by said threaded member.

19. The method of claim 18 including the further step of providing a bayonet type locking member in said access means opening to lockably retain said spring and said one or more spacing elements in the second chamber whereby very rapid access to said control elements for adjustability may be accomplished by removal of said bayonet member.

* * * * *